US006723907B2

(12) United States Patent
Sato

(10) Patent No.: US 6,723,907 B2
(45) Date of Patent: Apr. 20, 2004

(54) DRUM STAND

(75) Inventor: Naoki Sato, Seto (JP)

(73) Assignee: Hoshino Gakki Mfg. Co. Ltd. (JP)

( * ) Notice: Subject to any disclaimer, the term of this patent is extended or adjusted under 35 U.S.C. 154(b) by 0 days.

(21) Appl. No.: 10/171,443

(22) Filed: Jun. 13, 2002

(65) Prior Publication Data

US 2003/0126972 A1 Jul. 10, 2003

(30) Foreign Application Priority Data

Jan. 8, 2002 (JP) ..... 2002-001636

(51) Int. Cl.[7] ..... G10D 13/02
(52) U.S. Cl. ..... 84/421; 84/327; 84/329
(58) Field of Search ..... 84/421, 327, 328, 84/329

(56) References Cited

U.S. PATENT DOCUMENTS 2,245,883 A * 6/1941 Walberg ..... 84/421
5,467,680 A * 11/1995 Kurosaki ..... 84/421

* cited by examiner

*Primary Examiner*—Shih-Yung Hsieh
(74) *Attorney, Agent, or Firm*—Ostrolenk, Faber, Gerb & Soffen, LLP

(57) ABSTRACT

A drum stand includes three support arms and rubber sleeves, each of which is arranged on one of the support arms. The rubber sleeves support a drum. Each rubber sleeve includes a first portion, which faces the side portion of the drum, and a second portion, which faces the bottom of the drum. The second portions are more easily bent than the first portions.

13 Claims, 6 Drawing Sheets

DRUM STAND

BACKGROUND OF THE INVENTION

The present invention relates to a drum stand for supporting a drum. More specifically, the present invention pertains to a drum stand that softens the impact of beating a drum.

A typical snare drum stand includes three support arms and synthetic rubber sleeves. Each rubber sleeve covers the distal end of one of the support arms and supports a lower hoop of a snare drum placed on top. The rubber sleeves have substantially the same thickness and are thin.

Therefore, the rubber sleeves hardly absorb the impact of beating the snare drum. Thus, when a drummer beats the snare drum, which is supported by the rubber sleeves, with sticks, the impact is transmitted to the drummer's wrists. Particularly, when the drummer beats the rim of the snare drum with sticks, the impact is great. Beating the snare drum for a long time can create fatigue in the drummer's wrists.

SUMMARY OF THE INVENTION

Accordingly, it is an objective of the present invention to provide a drum stand that softens the impact of beating a drum.

To achieve the above objective, the present invention provides a drum stand, which includes at least three support arms and supporting members. Each supporting member is arranged on one of the support arms. The supporting members support a drum. The drum stand includes a plurality of first portions and a plurality of second portions. Each first portion forms a part of one of the supporting members and faces the side portion of the drum. Each second portion forms a part of one of the supporting members and faces the bottom of the drum. The second portions are more flexible than the first portions.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 5(*b*) is an enlarged partial cross-sectional view illustrating a drum stand according to a third embodiment;

FIG. 5(*c*) is an enlarged partial cross-sectional view illustrating a drum stand according to a fourth embodiment;

FIG. 5(*d*) is an enlarged partial cross-sectional view illustrating a drum stand according to a fifth embodiment;

FIG. 8(*c*) is an enlarged partial cross-sectional view illustrating a drum stand according to a modification of the seventh embodiment of the present invention.

DETAILED DESCRIPTION OF THE PREFERRED EMBODIMENTS

The first embodiment of the present invention will now be described with reference to FIGS. 1 to 4.

Figure 1:
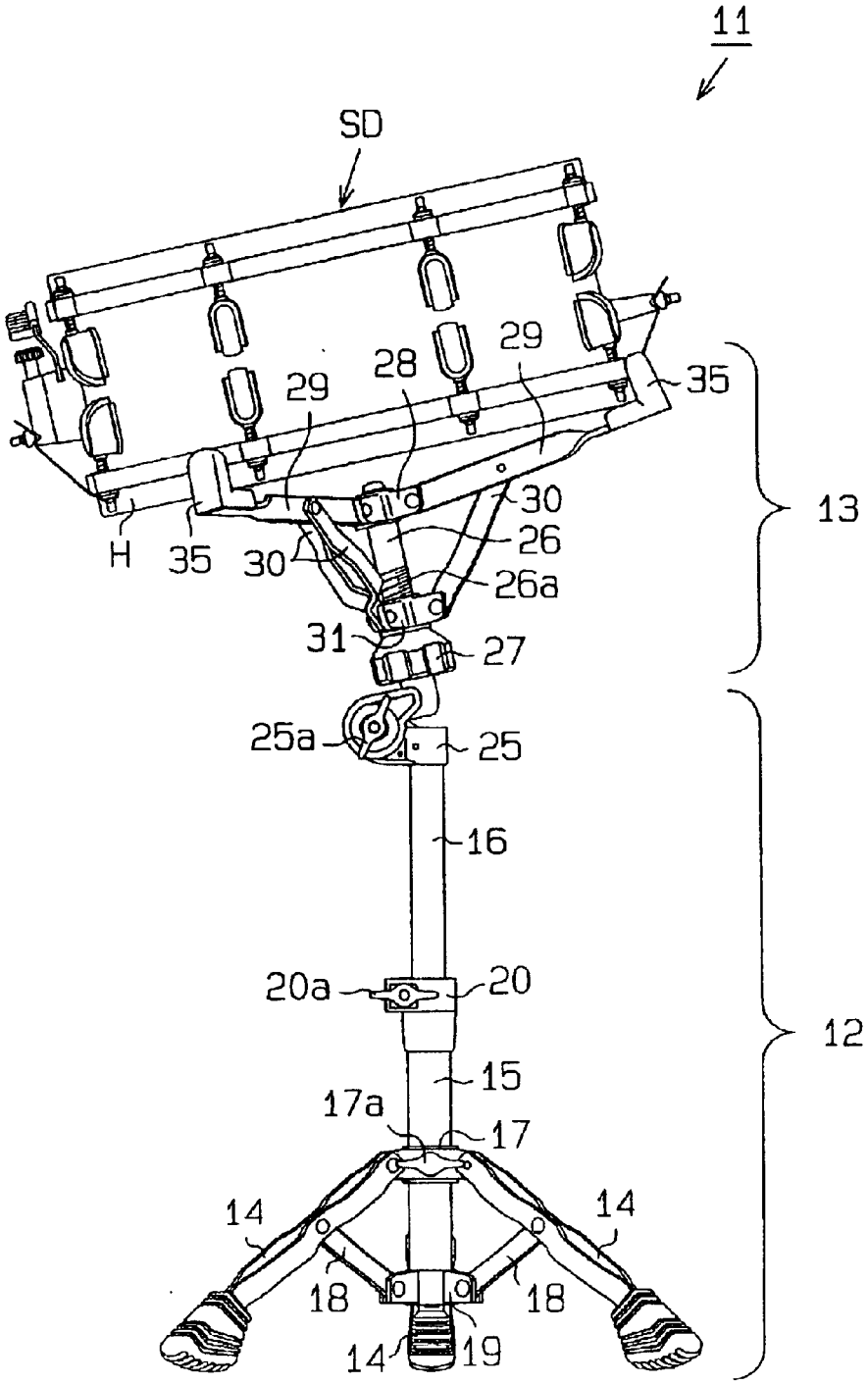
FIG. 1 is a front view illustrating a drum stand according to a first embodiment.

FIG. 1 is a front view of a drum stand 11. The drum stand 11 includes a base assembly 12 and a basket 13, which supports a snare drum SD.

The base assembly 12 includes three legs 14, a lower pipe 15, and an upper pipe 16. The upper end of each leg 14 is pivotally coupled to a first ring 17, which is fitted to the periphery of the lower pipe 15. Each leg 14 has a stay 18, one end of which is pivotally coupled to the center of the leg 14. The other end of each stay 18 is pivotally coupled to a second ring 19, which is secured at the lower end of the lower pipe 15. The legs 14 can be folded by vertically moving the first ring 17 along the lower pipe 15. The first ring 17 has a fastening screw 17*a* for securing the first ring 17 to the lower pipe 15.

The lower end of the upper pipe 16 is inserted in the lower pipe 15. A clamping mechanism 20 is secured to the upper end of the lower pipe 15. The upper pipe 16 is secured to the lower pipe 15 with the clamping mechanism 20. The clamping mechanism 20 has a fastening nut 20*a*. When the fastening nut 20*a* is loose, the upper pipe 16 can be moved up and down with respect to the lower pipe 15 to adjust the length of the base assembly 12.

A drum support pipe 26 is secured to the upper end of the upper pipe 16 with an angle adjusting mechanism 25. The angle adjusting mechanism 25 adjusts the angle between the upper pipe 16 and the drum support pipe 26. The angle adjusting mechanism 25 has a fastening nut 25*a*, which is loosened to adjust the angle and tightened to secure the upper pipe 16 and the drum support pipe 26.

A threaded portion 26*a* is formed at the lower half of the periphery of the drum support pipe 26. An adjusting nut 27 is threaded to the threaded portion 26*a*. A third ring 28 is secured to the upper end of the drum support pipe 26. Three support arms 29 are pivotally coupled to the third ring 28. Each support arm 29 has a stay 30, which is pivotally coupled to the center of the support arm 29. The other end of each stay 30 is pivotally coupled to a fourth ring 31, which is arranged about the drum support pipe 26 above the adjusting nut 27. The fourth ring 31 can be moved up and down along the drum support pipe 26.

Figure 3A:
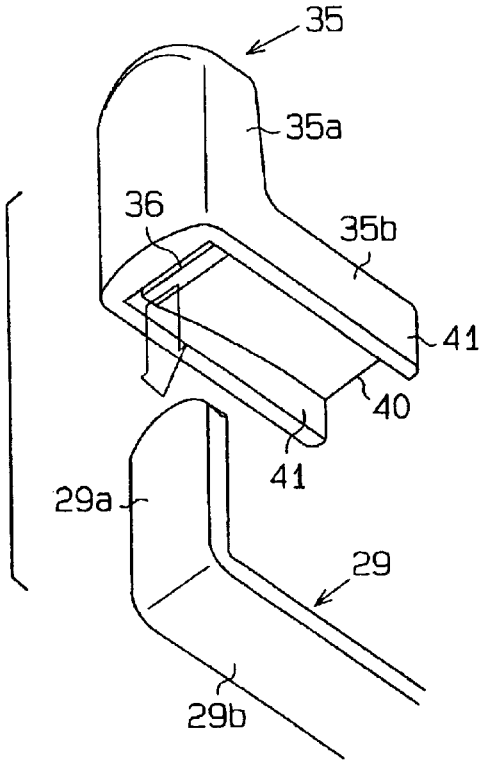
FIGS. 3(*a*) and 3(*b*) are enlarged partial perspective views illustrating one of the rubber sleeves according to the first embodiment.
Figure 3B:
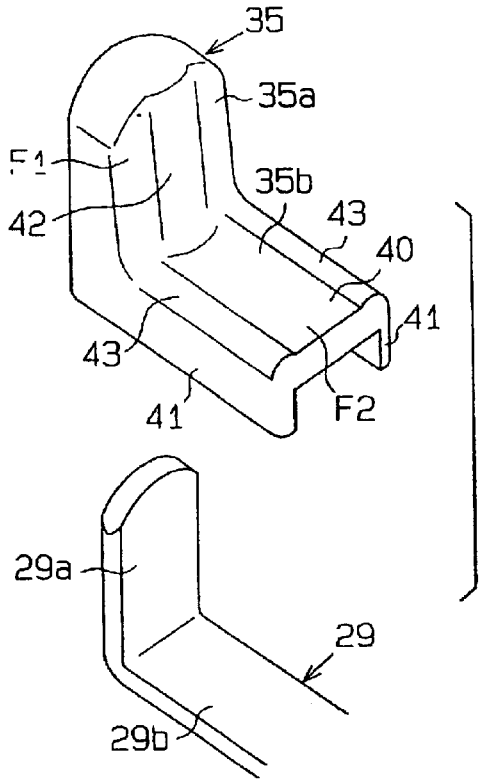

As shown in FIG. 3(*a*), each support arm 29 includes a drum rest 29*b*, which radially extend from the third ring 28, and a drum holder 29*a*, which extends upright from the distal end of the drum rest 29*b*. The drum holders 29*a* and the drum rests 29*b* are tabular.

Supporting members, which are synthetic rubber sleeves 35 in this embodiment, are each secured to the drum holder 29*a* of one of the support arms 29. The synthetic rubber is elastic. A lower hoop H of the snare drum SD is placed on the rubber sleeves 35. The support arms 29 support the snare drum SD in such a state a lower hoop H of the snare drum SD is placed on the rubber sleeves 35.

Figure 2:
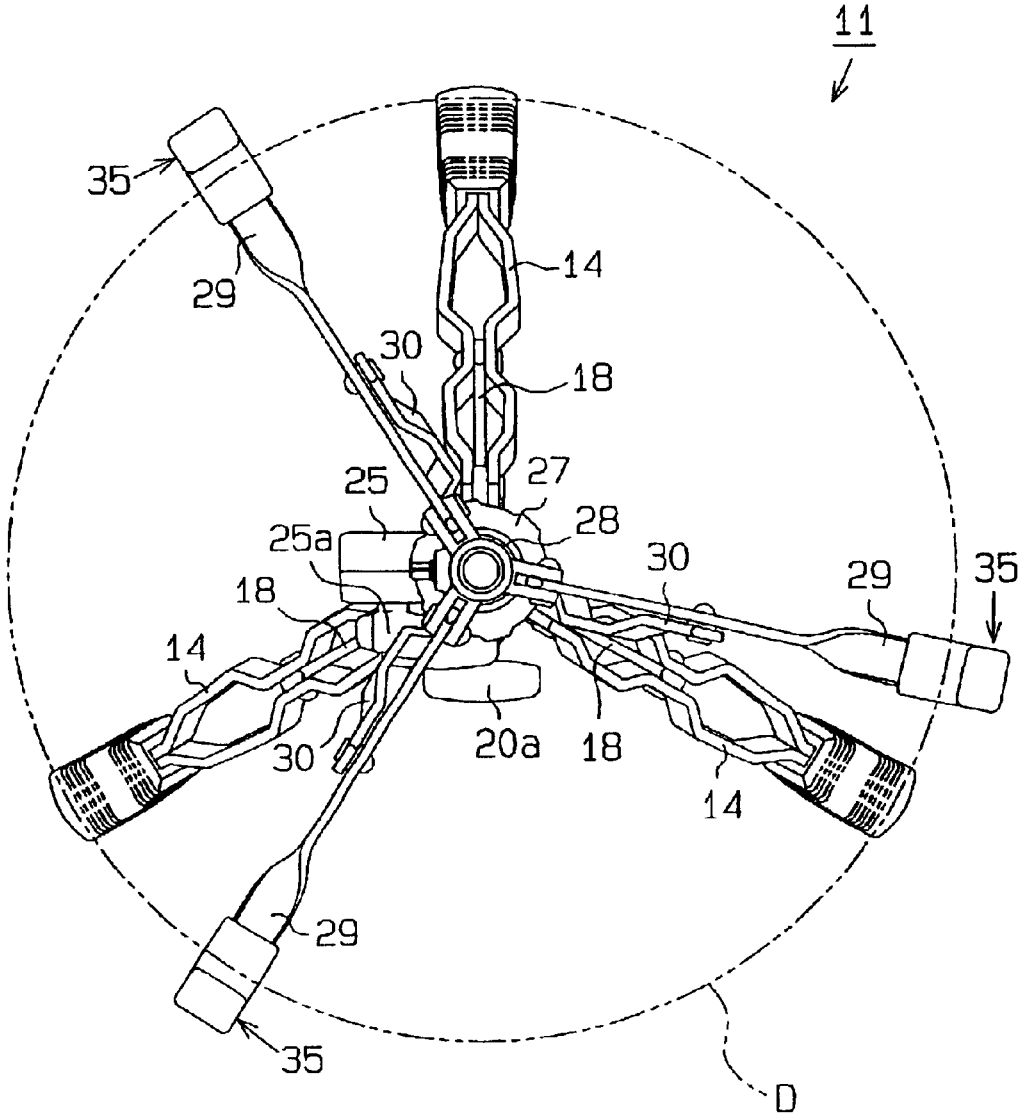
FIG. 2 is a plan view illustrating the drum stand according to the first embodiment.

The adjusting nut 27 is turned with respect to the threaded portion 26*a* of the drum support pipe 26 so that the adjusting nut 27 and the fourth ring 31 move along the axial direction of the drum support pipe 26. The fourth ring 31 presses the support arms 29 upward with the stays 30 when the fourth ring 31 approaches the third ring 28. This rotates the rubber sleeve 35 of each support arm 29 upward about the third ring 28. Thus, as shown in FIG. 2, the diameter of a circle D, which is drawn along the three rubber sleeves 35, changes. By matching the diameter of the circle D with the diameter of the snare drum SD, the snare drum SD can be supported by the drum stand 11 in a suitable manner.

When the adjusting nut 27 is turned and moved upward while the snare drum SD is supported by the rubber sleeves 35, a first portion 35*a* of each rubber sleeve 35 moves toward the center of the snare drum SD. Thus, the lower hoop H of the snare drum SD is firmly held. In this state, the snare drum SD and the drum stand 11 are integrated. Therefore, the snare drum SD and the drum stand 11 can be moved by lifting only the snare drum SD.

The rubber sleeves 35 will now be described.

As shown in FIGS. 3(*a*), 3(*b*), 4(*a*), and 4(*b*), each rubber sleeve 35 includes the first portion 35*a* and a second portion 35*b*. The first portion 35*a* covers one of the drum holders 29*a* entirely. The second portion 35*b* covers the top and sides of the corresponding drum rest 29*b*. Each first portion 35*a* has a hole 36, which is open downward. Each rubber sleeve 35 is secured to one of the support arms 29 by inserting the drum holder 29*a* of each support arm 29 in the hole 36.

Each second portion 35*b* includes a flexible portion 40 and a pair of side walls 41. Each flexible portion 40 is thin and located above one of the drum rests 29*b*. Each side wall 41 extends downward from one of the lateral sides of the flexible portion 40. The top surface of each flexible portion 40 is parallel to the corresponding drum rest 29*b*. The lower surface of each flexible portion 40 is inclined upward toward the third ring 28. That is, each flexible portion 40 becomes thinner toward the third ring 28. A space C is formed between each flexible portion 40 and the corresponding drum rest 29*b*. Each side wall 41 contacts one of the lateral side surfaces of the corresponding drum rest 29*b*. The side walls 41 restrict the movement of the corresponding flexible portion 40 in the width direction.

Each first portion 35*a* has a first surface F1, which faces the side portion of the snare drum SD. The first surface F1 includes a first projection 42, which is located along the lateral center of the first portion 35*a* perpendicular to the width direction. Each second portion 35*b* has a second surface F2, which faces the bottom of the snare drum SD. The second surface F2 includes a pair of second projections 43. Each second projection 43 projects along one of the lateral edges of the second portion 35*b* perpendicular to the width direction. The first projections 42 and the pairs of second projections 43 contact the lower hoop H of the snare drum SD. The flat portion of each first surface F1 and the flat portion of each second surface F2 do not contact the lower hoop H of the snare drum SD.

The operation of the drum stand 11 according to the first embodiment will now be described.

To facilitate the explanation, the snare drum SD is not held by the first portion 35*a* of each rubber sleeve 35 but is only placed on the second portion 35*b* of each rubber sleeve 35.

Figure 4A:
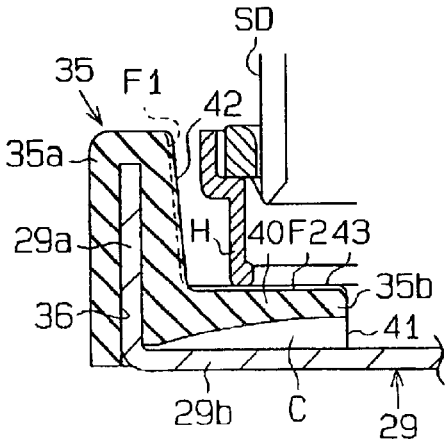
FIGS. 4(*a*) and 4(*b*) are enlarged partial cross-sectional views illustrating the relationship between one of the rubber sleeves and the snare drum according to the first embodiment.
Figure 4B:
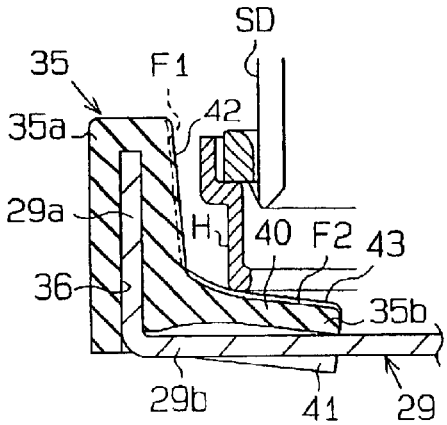
Figure 5B:
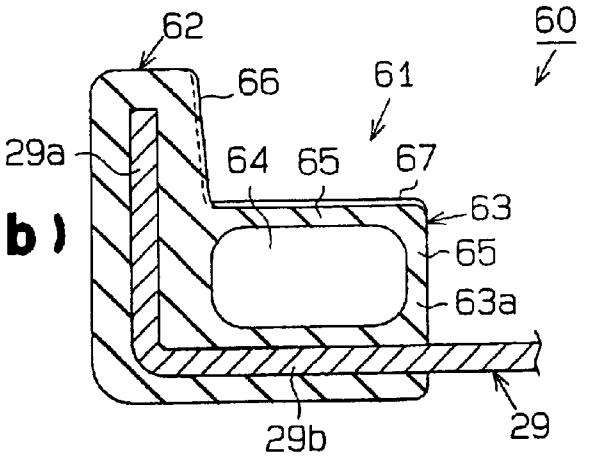
FIG. 5(*a*) is an enlarged partial cross-sectional view illustrating a drum stand according to a second embodiment.
Figure 5D:
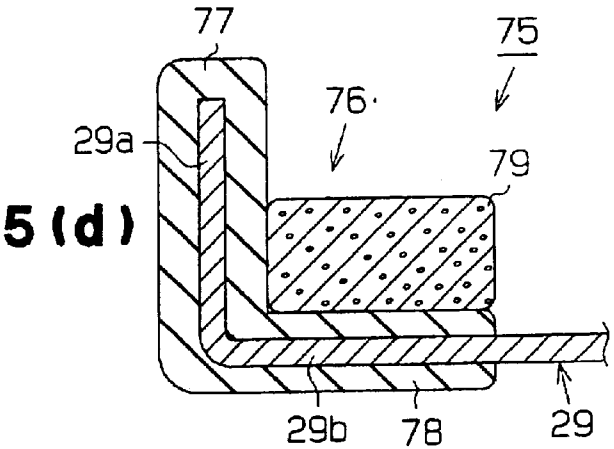
Figure 5A:
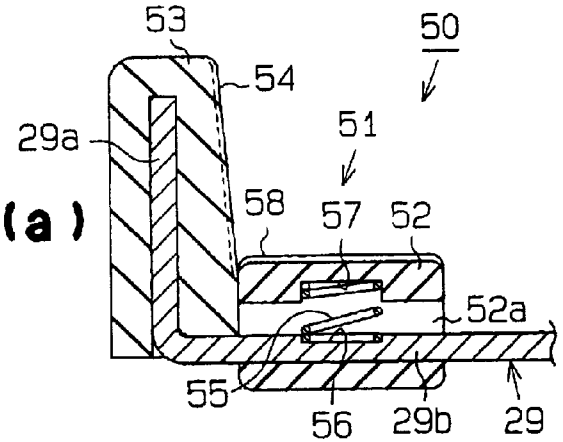
Figure 5C:
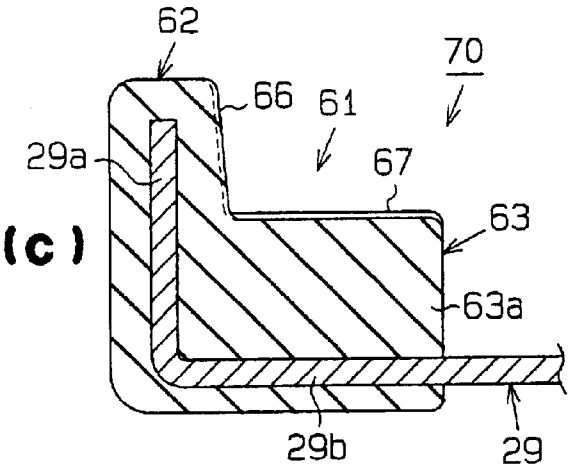

In this state, the lower hoop H of the snare drum SD is placed on the flexible portion 40 of each rubber sleeve 35. More specifically, the lower hoop H is placed on the pairs of second projections 43. Therefore, when a drummer beats the snare drum SD with sticks, each flexible portion 40 is bent as shown in FIG. 4(*b*). This softens the impact generated in the axial direction of the snare drum SD. Particularly, only one end of each second portion 35*b* (flexible portion 40) is supported by one of the first portion 35*a* and the space C is provided between each flexible portion 40 and the corresponding drum rest 29*b*. Therefore, when a drummer beats the snare drum SD, the flexible portions 40 are deformed in a suitable manner.

Furthermore, each flexible portion 40 has the side walls 41 extending downward from the lateral sides. Each side wall 41 contacts one of the lateral side surfaces of the corresponding drum rest 29*b*. Therefore, each flexible portion 40 is prevented from being displaced in the width direction.

The second portions 35*b* are more flexible (are bent more easily) than the first portions 35*a*. This decreases the strain on the drummer's wrists when the drummer beats the snare drum SD with sticks.

The lower hoop H of the snare drum SD is supported by the pair of second projections 43 formed on each flexible portion 40. Therefore, compared with a case when each flexible portion 40 does not have projections, each flexible portion 40 of the first embodiment has less contact area. Therefore, according to the first embodiment, the decrease in resonance of the snare drum SD is less.

The pair of second projections 43 is formed along the lateral edges of the second surface F2 of each second portion 35*b*. Therefore, compared with a case when a projection is formed along the lateral center of each second surface F2 perpendicular to the width direction, each second surface F2 is more reliably prevented from contacting the lower hoop H.

If a projection is formed along the lateral center of each second surface F2 instead of along the lateral sides of each second surface F2, the upper end of the projection might become flush with the lateral edges of the flexible portion 40 when the projection is bent downward. This is because each flexible portion 40 is thin. In this case, the lateral edges of each flexible portion 40 also contact the lower hoop H in addition to the projection. This easily decreases the resonance of the snare drum SD. However, according to the first embodiment, each second projection 43 is arranged above one of the side walls 41 with the flexible portion 40 in between. Therefore, each pair of second projections 43 do not become hollow and the lower hoop H is reliably supported only by each pair of second projections 43.

On the other hand, when the snare drum SD is firmly held by the first portion 35*a* of each rubber sleeve 35 to be secured to the drum stand 11, the holding strength with respect to the snare drum SD is increased. Accordingly, the amount of depression of the snare drum SD when beaten by sticks decreases. Thus, the elasticity of the rubber sleeves 35 can be adjusted by changing the strength of holding the snare drum SD.

The drum stand 11 according to the first embodiment provides the following advantages.

(1) In the first embodiment, the second portion 35*b* of each rubber sleeve 35 bends more easily than the first portion 35*a* of each rubber sleeve 35. Therefore, the first embodiment differs from the prior art in that the second portions 35*b* soften the impact of beating the snare drum SD with sticks while the snare drum SD is supported by the rubber sleeves 35. As a result, the strain on the drummer's wrist is decreased.

(2) In the first embodiment, the first portion 35*a* of each rubber sleeve 35 is secured to the drum holder 29*a* of one of the support arms 29. Then, one end of each second portion 35*b* is supported by one of the first portions 35*a*. Therefore, each second portion 35*b* can easily be bent.

(3) In the first embodiment, each second portion 35*b* has the flexible portion 40, which is thin. Each flexible portion 40 bends in the axial direction of the snare drum SD. Therefore, when the drummer beats the snare drum SD with sticks, the impact is absorbed by the flexible portions 40. Also, the snare drum SD is supported by the rubber sleeves 35. Therefore, the snare drum SD is not shifted laterally. This allows the drummer to beat the snare drum in a suitable manner.

(4) In the first embodiment, the space C is formed between each flexible portion 40 and the corresponding drum rest 29*b* to permit each flexible portion 40 to be deformed in a suitable manner. Therefore, each flexible portion 40 can more efficiently absorb the impact of beating the snare drum SD with sticks. Also, each flexible portion 40 is prevented from flexing more than required since the dimension of the space C is determined in advance.

(5) In the first embodiment, each flexible portion 40 has side walls 41 extending downward from the lateral sides. Each side wall 41 contacts one of the lateral side surfaces of the corresponding drum rest 29*b* and restricts the movement of the flexible portion 40 in the width direction. Therefore, each flexible portion 40 is not displaced in the width direction and is reliably bent only in the axial direction of the snare drum SD.

(6) In the first embodiment, the pair of second projections 43 is formed on the second surface F2 of each second portion 35*b*. Each pair of second projections 43 contact the lower hoop H of the snare drum SD so that the flat portion of each second surface F2 does not contact the lower hoop H. Therefore, the contact area is small and thus the resonance of the snare drum SD is not easily decreased.

(7) In the first embodiment, the pair of second projections 43 is formed along the lateral edges of the second surface F2 of each second portion 35*b*. The second projections 43 are arranged just above the side walls 41 with the flexible portion 40 in between. Therefore, the pair of second projections 43 on each flexible portion 40 does not become hollow. Thus, the lower hoop H can reliably be supported only by each pair of second projections 43.

(8) In the first embodiment, the first projection 42 is formed on the first surface F1 of each first portion 35*a*. When the lower hoop H of the snare drum SD is held by the first portion 35*a* of each rubber sleeve 35, the first projections 42 contact the lower hoop H. In this state, the flat portion of each first surface F1 does not contact the lower hoop H. Therefore, the contact area is small and thus the resonance of the snare drum SD is not easily decreased.

(9) In the first embodiment, each first portion 35*a* has the hole 36, which is open downward. The drum holder 29*a* of each support arm 29 is inserted in one of the holes 36 so that the corresponding rubber sleeve 35 is secured to the support arm 29. Therefore, compared with a conventional drum stand, in which the support rubber is molded to the entire distal end of each L-shaped support arm, the drum stand 11 according to the first embodiment is easy to assemble by only fitting each rubber sleeve 35 to the drum holder 29*a* of one of the support arms 29.

A second embodiment of the present invention will now be described with reference to FIG. 5(*a*). Only the structure of the rubber sleeves 35 of the drum stand 11 according to the first embodiment is modified in the drum stand according to the embodiments listed below including the second embodiment. The differences from the first embodiment will mainly be discussed below and like or the same reference numerals are given to those components that are like or the same as the corresponding members of the first embodiment and detailed explanations are omitted.

The drum stand 50 according to the second embodiment includes supporting members, which are synthetic rubber sleeves 51. Each rubber sleeve 51 includes a first portion 53 and a second portion 52. The first portion 53 is secured to the drum holder 29*a* of one of the support arms 29. The second portion 52 is a rectangular tube and is secured to the drum rest 29*b* of one of the support arms 29. The first portion 53 and the second portion 52 are separate pieces. A projection 54, which corresponds to the first projection 42 of the first embodiment, is formed along the lateral center of the side surface of each first portion 53. Each side surface faces the snare drum SD.

The side walls of each second portion 52 are flexible portions 52*a*. A recess 56 is formed in the upper surface of each drum rest 29*b*. One end of an impact absorbing member, which is a coil spring 55 in the second embodiment, is accommodated in each recess 56 inside the corresponding second portion 52. Another recess 57 is formed in the inner surface of each second portion 52, which faces the upper surface of one of the drum rests 29*b*. The upper end of each coil spring 55 is accommodated in the recess 57 of the corresponding second portion 52. Thus, the coil spring 55 is arranged between the recesses 56, 57.

A pair of projections 58, which corresponds to the pair of second projections 43 of the first embodiment, is formed along the lateral sides of the side surface of each second portion 52. Each side surface faces the snare drum SD.

Therefore, in the second embodiment, when the drummer beats the snare drum SD with sticks while the snare drum SD is supported by the drum stand 50, each flexible portion 52*a* bends in the axial direction of the snare drum SD. This causes the coil spring 55 to deform against own elasticity. As a result, the impact generated in the axial direction of the snare drum SD softens.

The drum stand 50 according to the second embodiment of the present invention provides the following advantage in addition to substantially the same advantages as the advantages (1), (3), (6), (7), and (8) of the first embodiment.

(1) In the second embodiment, each rubber sleeve 51 includes the second portion 52, which is a square cylinder. The coil spring 55 is arranged between the recess 56 of each drum rest 29*b* and the recess 57 of the corresponding second portion 52. The impact generated when beating the snare drum SD is softened by the reaction force of each coil spring 55. Therefore, the impact absorbing capability can be changed by adjusting the reaction force of each coil spring 55. Also, the elasticity of the second portions 52 can easily be adjusted by only exchanging the coil springs 55.

FIG. 5(*b*) illustrates a third embodiment of the present invention.

A drum stand 60 according to the third embodiment includes supporting members, which are rubber sleeves 61 made of synthetic rubber. Each rubber sleeve 61 includes a first portion 62 and a second portion 63. The first portion 62 covers the periphery of one of the drum holder 29*a*. The second portion 63 covers the periphery of one of the drum rest 29*b*. Each first portion 62 and the corresponding second portion 63 are integrally formed by molding the synthetic rubber to one of the drum holder 29*a* and the corresponding drum rest 29*b*.

A part of each second portion 63 that is located above the corresponding drum rest 29*b* is thicker than a part of each first portion 62 that is located toward the third ring 28 from the corresponding drum holder 29*a*. The thick portion is denoted with a numeral 63*a*. The thick portion 63*a* has a hollow 64 and serves as an impact absorbing member, which is an air cushion in the third embodiment. The part of the thick portion 63*a* that is located above the hollow 64 and the side portions are flexible portions 65.

A projection 66, which corresponds to the first projection 42 of the first embodiment, is formed along the lateral center of the side surface of each first portion 62. Each side surface faces the snare drum SD. Also, a pair of projections 67, which corresponds to the pair of second projections 43 of the first embodiment, is formed along the lateral sides of the side surface of each second portion 63. Each side surface faces the snare drum SD.

Therefore, when the drummer beats the snare drum SD with sticks while the snare drum SD is supported by the drum stand 60, each thick portion 63*a*, which has the hollow 64, functions as the air cushion and the flexible portions 65 are bent in the axial direction of the snare drum SD. As a result, the impact generated in the axial direction of the snare drum SD softens.

Therefore, the drum stand 60 according to the third embodiment of the present invention provides substantially the same advantages as the advantages (1), (3), (6), (7), and (8) of the first embodiment. In addition, the impact is absorbed by the flexibility of the flexible portions 65 and the thick portion 63*a* serving as the air cushion.

FIG. 5(*c*) illustrates a fourth embodiment of the present invention. The drum stand 70 according to the fourth embodiment is equivalent to the drum stand 60 of the third embodiment with the hollow portion 64 of each rubber sleeve 61 being omitted.

That is, a part of each second portion 63 that is located above the corresponding drum rest 29*b* includes a thick portion 63*a*, which is thicker than a part of the corresponding first portion 62 that is located toward the third ring 28 from the corresponding drum holder 29*a*. Therefore, the thick portion 63*a* is easily bent.

The impact of beating the snare drum SD is absorbed by the bending of the thick portions 63*a*. Therefore, the drum stand 70 of the fourth embodiment provides substantially the same advantages as the advantages (1), (6), (7), and (8) of the first embodiment.

FIG. 5(*d*) illustrates a fifth embodiment of the present invention. A drum stand 75 of the fifth embodiment includes supporting members, which are synthetic rubber sleeves 76. Each rubber sleeve 76 includes a first portion 77 and a second portion 78, which cover the drum holder 29*a* and the corresponding drum rest 29*b* by a uniform thickness, respectively. An impact absorbing member, which is a sponge 79 in the fifth embodiment, is secured to the top surface of each second portion 78.

The impact of beating the snare drum SD is absorbed by the deformation of the sponges 79.

Therefore, the drum stand 75 according to the fifth embodiment of the present invention provides substantially the same advantage as the advantage (1) of the first embodiment.

Figure 6A:
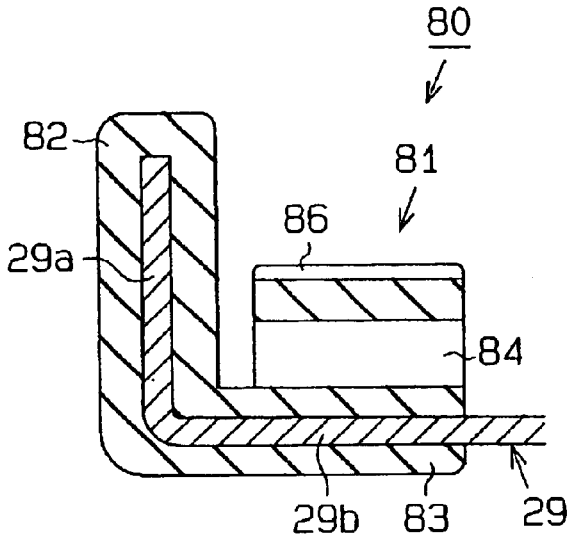
FIGS. 6(*a*) and 6(*b*) are enlarged partial cross-sectional views illustrating a drum stand according to a sixth embodiment.
Figure 6B:
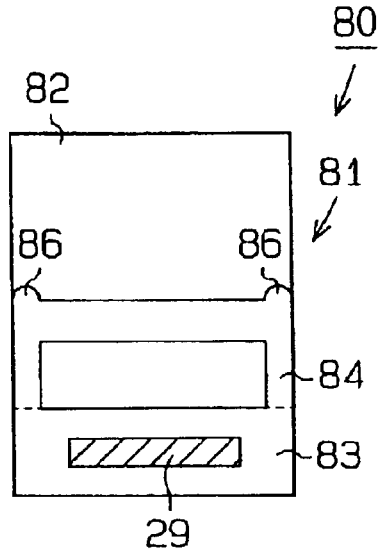

FIGS. 6(*a*) and 6(*b*) illustrate a sixth embodiment of the present invention. A drum stand 80 according to the sixth embodiment includes supporting members, which are synthetic rubber sleeves 81. Each rubber sleeve 81 includes a first portion 82 and a second portion 83, which cover the drum holder 29*a* and the corresponding drum rest 29*b* by a uniform thickness, respectively. A flexible portion 84 is integrally formed on top of each second portion 83. Each flexible portion 84 is thin and has a reversed U-shape cross-section. A pair of projections 86, which corresponds to the pair of second projections 43 of the first embodiment, is formed along the lateral sides of the top surface of each flexible portion 84. Each top surface faces the snare drum SD.

The impact of beating the snare drum SD is absorbed by the deformation of the flexible portions 84.

Therefore, the drum stand 80 according to the sixth embodiment of the present invention provides substantially the same advantages as the advantages (1), (3), (6), and (7) of the first embodiment.

Figure 7A:
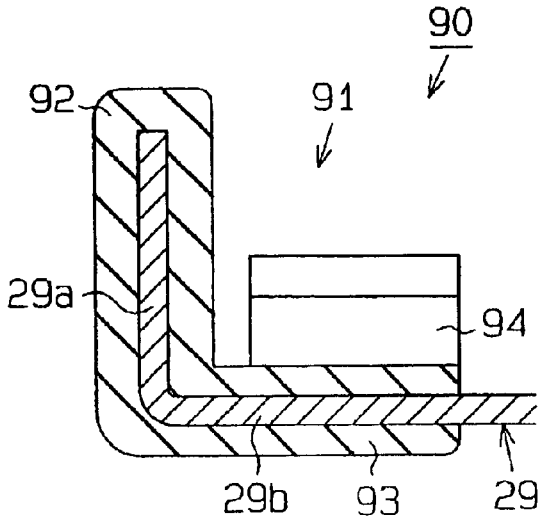
FIGS. 7(*a*) and 7(*b*) are enlarged partial cross-sectional views illustrating a drum stand according to a seventh embodiment.
Figure 7B:
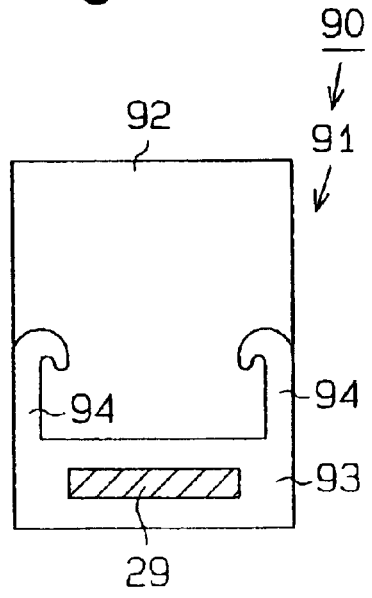

FIGS. 7(*a*) and 7(*b*) illustrate a seventh embodiment of the present invention. A drum stand 90 according to the seventh embodiment includes supporting members, which are synthetic rubber sleeves 91. Each rubber sleeve 91 includes a first portion 92 and a second portion 93, which cover the drum holder 29*a* and the corresponding drum rest 29*b* by a uniform thickness, respectively. Each first portion 92 and the corresponding second portion 93 are integrally formed.

A pair of flexible portions 94 is formed along the lateral edges of each second portion 93. Each flexible portion 94 projects upward and the distal end of each flexible portion 94 curves inward. The pairs of flexible portions 94 provide substantially the same advantages as the pairs of second projections 43 of the first embodiment. The impact of beating the snare drum SD is absorbed by the bending of each pair of flexible portions 94.

Therefore, the drum stand 90 according to the seventh embodiment of the present invention provides substantially the same advantages as the advantages (1) and (3) of the first embodiment.

It should be apparent to those skilled in the art that the present invention may be embodied in many other specific forms without departing from the spirit or scope of the invention. Particularly, it should be understood that the invention may be embodied in the following forms.

Figure 8A:
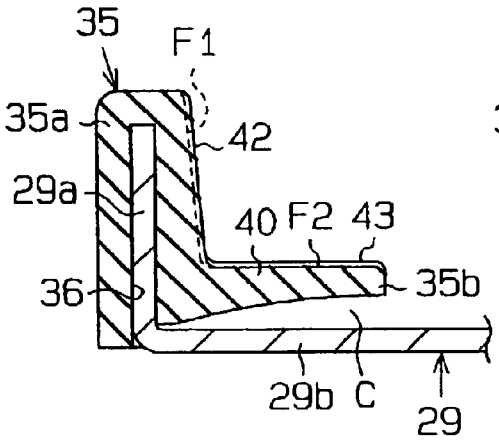
FIGS. 8(*a*) and 8(*b*) are enlarged partial cross-sectional views illustrating a drum stand according to a modification of the first embodiment of the present invention.
Figure 8B:
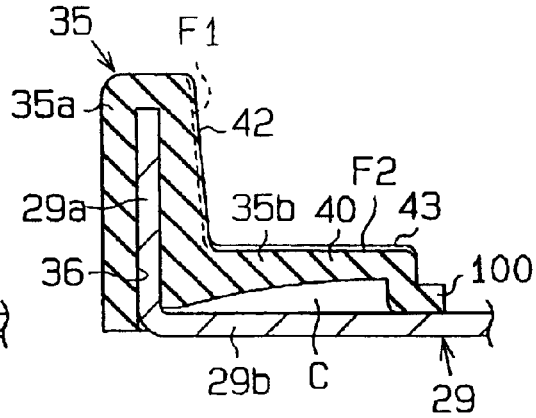
Figure 8C:
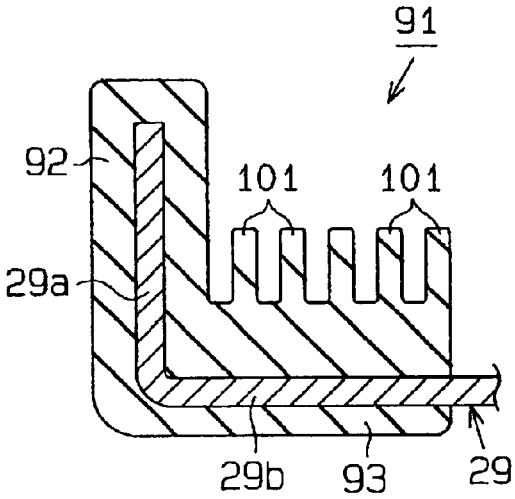

As shown in FIG. 4(*a*), each rubber sleeve 35 of the first embodiment has side walls 41. However, the side walls 41 may be omitted as shown in FIG. 8(*a*). Also, as shown in FIG. 8(*b*), a bend suppressing portion 100, which extends downward from the end of each flexible portion 40 and contacts the corresponding drum rest 29*b*, may be formed. Each bend suppressing portion 100 suppresses the deformation of the corresponding flexible portion 40.

Instead of the flexible portion 94 illustrated in FIG. 7(*b*), thin walls 101 may be projected from the upper surface of each base portion 93 as shown in FIG. 8(*c*).

A leaf spring, a sponge, a gel, or the like may be arranged instead of each coil spring 55 illustrated in FIG. 5(*a*). Preferably, the impact absorbing member is a coil spring, an air cushion, or a sponge.

The projections 43, 58, 67, and 86 according to the first, second, third, fourth, and sixth embodiments may be omitted. The projections 42, 54, and 66 according to the first to fourth embodiment may also be omitted.

The present invention may be structured to support a drum other than the snare drum SD. The number of the support arms 29 of the drum stand may be greater than or equal to four.

Therefore, the present examples and embodiments are to be considered as illustrative and not restrictive and the invention is not to be limited to the details given herein, but may be modified within the scope and equivalence of the appended claims.

What is claimed is:

1. A drum stand, comprising at least three support arms and supporting members, each supporting member is arranged on one of the support arms, and the supporting members support a drum;

a plurality of first portions, wherein each first portion forms a part of one of the supporting members, and wherein each first portion faces a side portion of the drum; and a plurality of second portions, wherein each second portion forms a part of one of the supporting members, and wherein each second portion faces a bottom of the drum, wherein the second portions are more flexible than the first portions;

wherein at least the first portions out of the first portions and the second portions are each secured to one of the support arms;

wherein each second portion includes a thin flexible portion and bends in the axial direction of the drum.

2. The drum stand according to claim 1, wherein a space is defined between each flexible portion and the corresponding support arm, and wherein each space permits the corresponding flexible portion to flex.

3. The drum stand according to claim 1, wherein each flexible portion has a pair of side walls extending downward from the sides, wherein each support arm is arranged between one of the pairs of side walls.

4. The drum stand according to claim 1, wherein a projection is formed on each supporting member for contacting the drum.

5. The drum stand according to claim 4, wherein each flexible portion has a top surface and the projection is formed on the top surface of each flexible portion.

6. The drum stand according to claim 1, further comprising an impact absorbing member is arranged on each second portion.

7. The drum stand according to claim 6, wherein the impact absorbing member is one of a coil spring, an air cushion and a sponge.

8. A drum stand, comprising:

three support arms and supporting members, wherein each supporting member is arranged on one of the support arms, and wherein the supporting members support a drum;

a plurality of first portions, wherein each first portion forms a part of one of the supporting members, and wherein each first portion is secured to one of the support arms to face a side portion of the drum; and a plurality of second portions, wherein each second portion forms a part of one of the supporting members, and wherein each second portion is attached to one of the support arms to face a bottom of the drum, wherein the second portions are more flexible than the first portions;

wherein each second portion includes a thin flexible portion, and wherein each flexible portion bends in the axial direction of the drum.

9. The drum stand according to claim 8, wherein a space is defined between each flexible portion and the corresponding support arm, and wherein each space permits the corresponding flexible portion to flex.

10. The drum stand according to claim 8, wherein each flexible portion has side walls extending downward from the sides, wherein each support arm is arranged between one of the side walls.

11. The drum stand according to claim 8, wherein a projection is formed on each supporting member for contacting the drum.

12. The drum stand according to claim 11, wherein each flexible portion has a top surface and the projection is formed on the top surface of each flexible portion.

13. The drum stand according to claim 8, wherein the supporting members are formed with synthetic rubber.

* * * * *